US008647064B2

(12) United States Patent
Boyer

(10) Patent No.: US 8,647,064 B2
(45) Date of Patent: Feb. 11, 2014

(54) BUCKET ASSEMBLY COOLING APPARATUS AND METHOD FOR FORMING THE BUCKET ASSEMBLY

(75) Inventor: Bradley Taylor Boyer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 735 days.

(21) Appl. No.: 12/852,802

(22) Filed: Aug. 9, 2010

(65) Prior Publication Data

US 2012/0034102 A1 Feb. 9, 2012

(51) Int. Cl.
*F01D 5/18* (2006.01)

(52) U.S. Cl.
USPC ..... 416/97 R; 416/96 R; 416/193 A

(58) Field of Classification Search
USPC ..... 29/889.72, 889.721, 889.722; 416/193 A, 96 R, 97 R
See application file for complete search history.

(56) References Cited

U.S. PATENT DOCUMENTS

| | | | |
|---|---|---|---|
| 4,017,213 | A | 4/1977 | Przirembel |
| 5,340,278 | A | 8/1994 | Magowan |
| 5,382,135 | A | 1/1995 | Green |
| 5,639,216 | A | 6/1997 | McLaurin et al. |
| 5,813,835 | A | 9/1998 | Corsmeier et al. |
| 5,848,876 | A | 12/1998 | Tomita |
| 5,915,923 | A | 6/1999 | Tomita et al. |
| 6,017,189 | A | 1/2000 | Judet et al. |
| 6,019,579 | A | 2/2000 | Fukuno et al. |
| 6,065,931 | A | 5/2000 | Suenaga et al. |
| 6,071,075 | A | 6/2000 | Tomita et al. |
| 6,079,946 | A | 6/2000 | Suenaga et al. |
| 6,092,991 | A | 7/2000 | Tomita et al. |
| 6,120,249 | A | 9/2000 | Hultgren et al. |
| 6,132,173 | A | 10/2000 | Tomita et al. |
| 6,190,130 | B1 | 2/2001 | Fukue et al. |
| 6,196,799 | B1 | 3/2001 | Fukue et al. |
| 6,309,175 | B1 | 10/2001 | Hahnle et al. |
| 6,390,774 | B1 | 5/2002 | Lewis et al. |
| 6,402,471 | B1 | 6/2002 | Demers et al. |
| 6,416,284 | B1 | 7/2002 | Demers et al. |
| 6,431,833 | B2 | 8/2002 | Jones |
| 6,478,540 | B2 | 11/2002 | Abuaf et al. |
| 6,481,967 | B2 | 11/2002 | Tomita et al. |
| 6,644,920 | B2 | 11/2003 | Beeck et al. |
| 6,945,749 | B2 | 9/2005 | De Cardenas |
| 7,097,424 | B2 | 8/2006 | Cunha et al. |
| 7,131,817 | B2 | 11/2006 | Keith et al. |
| 7,144,215 | B2 | 12/2006 | Keith et al. |
| 7,147,439 | B2 | 12/2006 | Jacala et al. |
| 7,147,440 | B2 | 12/2006 | Benjamin et al. |
| 7,198,467 | B2 | 4/2007 | Keith et al. |

(Continued)

*Primary Examiner* — Edward Look
*Assistant Examiner* — Aaron R Eastman
(74) *Attorney, Agent, or Firm* — Dority & Manning, PA

(57) ABSTRACT

A bucket assembly and a method for forming the bucket assembly are disclosed. The bucket assembly includes a platform, an airfoil, and a lower body portion. The platform defines a platform cooling circuit configured to flow cooling medium therethrough. The airfoil extends radially outward from the platform. The lower body portion extends radially inward from the platform. The lower body portion defines a root and a cooling passage extending from the root. The cooling passage is configured to flow cooling medium therethrough. The platform and lower body portion further include a ligament between the cooling passage and the platform cooling circuit. The ligament defines a bore hole extending through the ligament between the cooling passage and the platform cooling circuit.

12 Claims, 5 Drawing Sheets

(56) References Cited

U.S. PATENT DOCUMENTS

| | | | | |
|---|---|---|---|---|
| 7,255,536 | B2 | 8/2007 | Cunha et al. | |
| 7,309,212 | B2 | 12/2007 | Itzel et al. | |
| 7,322,396 | B2 * | 1/2008 | Govern et al. | 164/122.1 |
| 7,416,391 | B2 | 8/2008 | Veltre et al. | |
| 2005/0058545 | A1 * | 3/2005 | Cardenas | 416/97 R |
| 2006/0056968 | A1 | 3/2006 | Jacala et al. | |
| 2007/0116574 | A1 * | 5/2007 | Itzel et al. | 416/193 A |
| 2007/0140848 | A1 | 6/2007 | Charbonneau et al. | |
| 2007/0189896 | A1 | 8/2007 | Itzel et al. | |
| 2008/0138209 | A1 * | 6/2008 | Cunha et al. | 416/97 R |
| 2008/0226462 | A1 * | 9/2008 | Albert et al. | 416/97 R |
| 2010/0247328 | A1 * | 9/2010 | Cunha | 416/97 R |
| 2010/0329888 | A1 * | 12/2010 | Nadvit et al. | 416/97 R |
| 2011/0058949 | A1 * | 3/2011 | Marra | 416/233 |
| 2011/0204205 | A1 * | 8/2011 | Kamel et al. | 249/184 |
| 2011/0223004 | A1 * | 9/2011 | Lacy et al. | 415/115 |
| 2012/0269648 | A1 * | 10/2012 | Lee | 416/97 R |

* cited by examiner

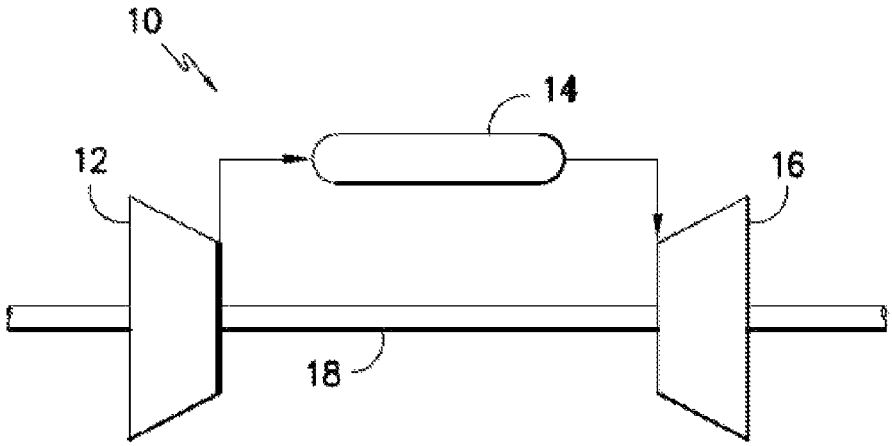
FIG. –1–
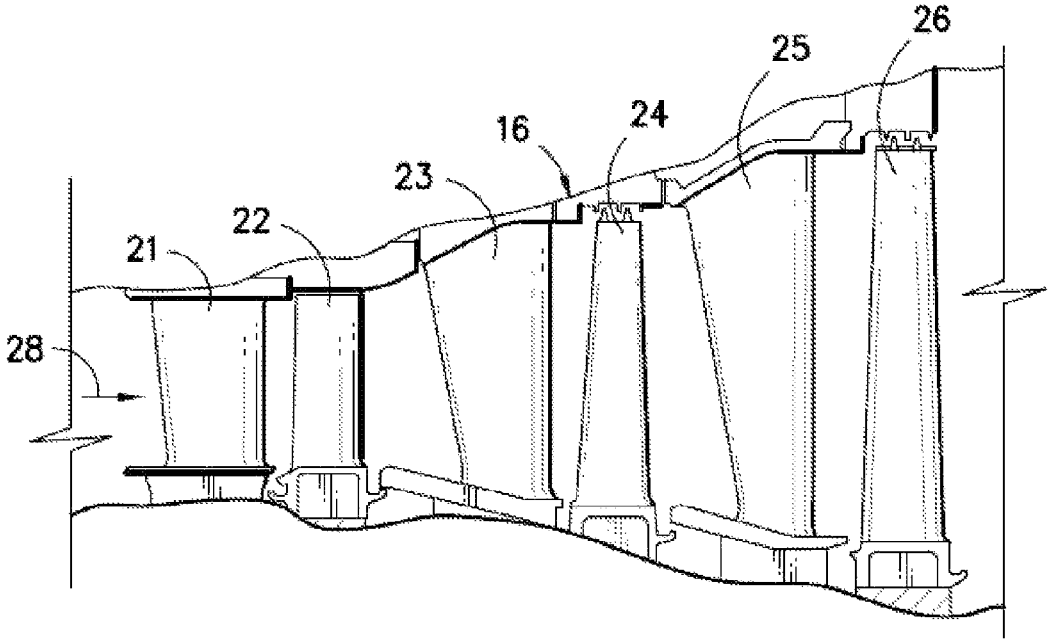
FIG. –2–

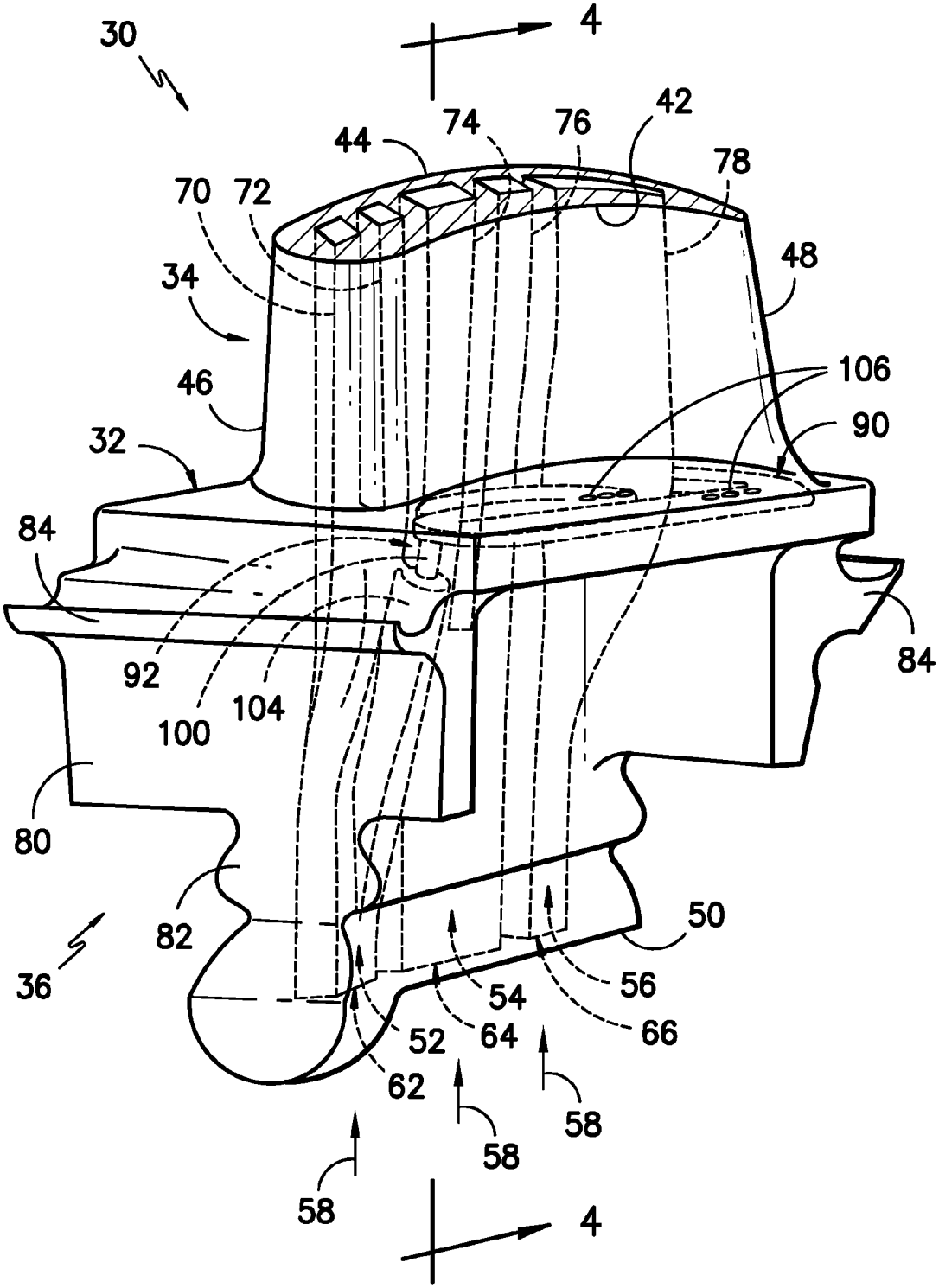
FIG. —3—

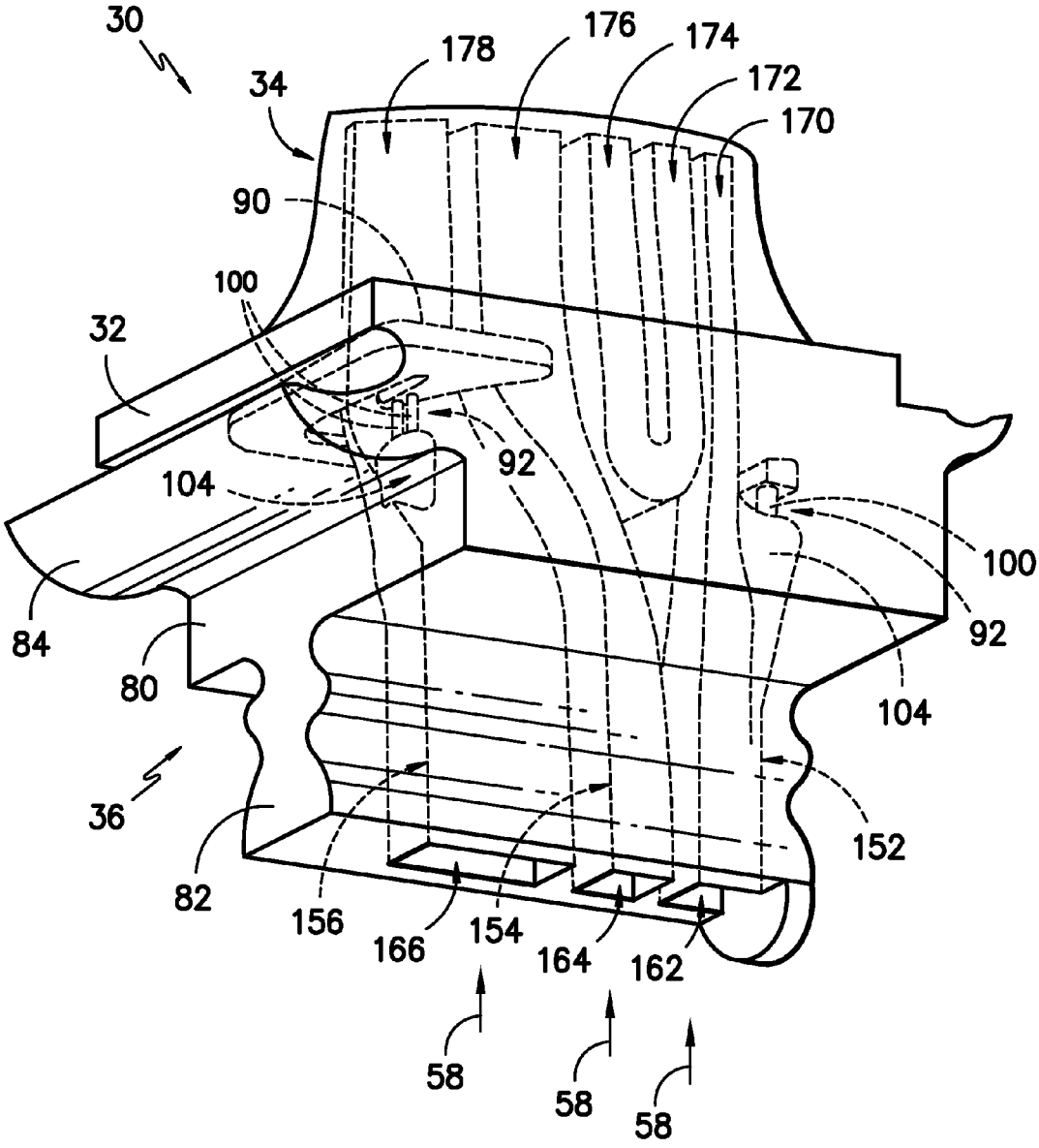
FIG. –5–

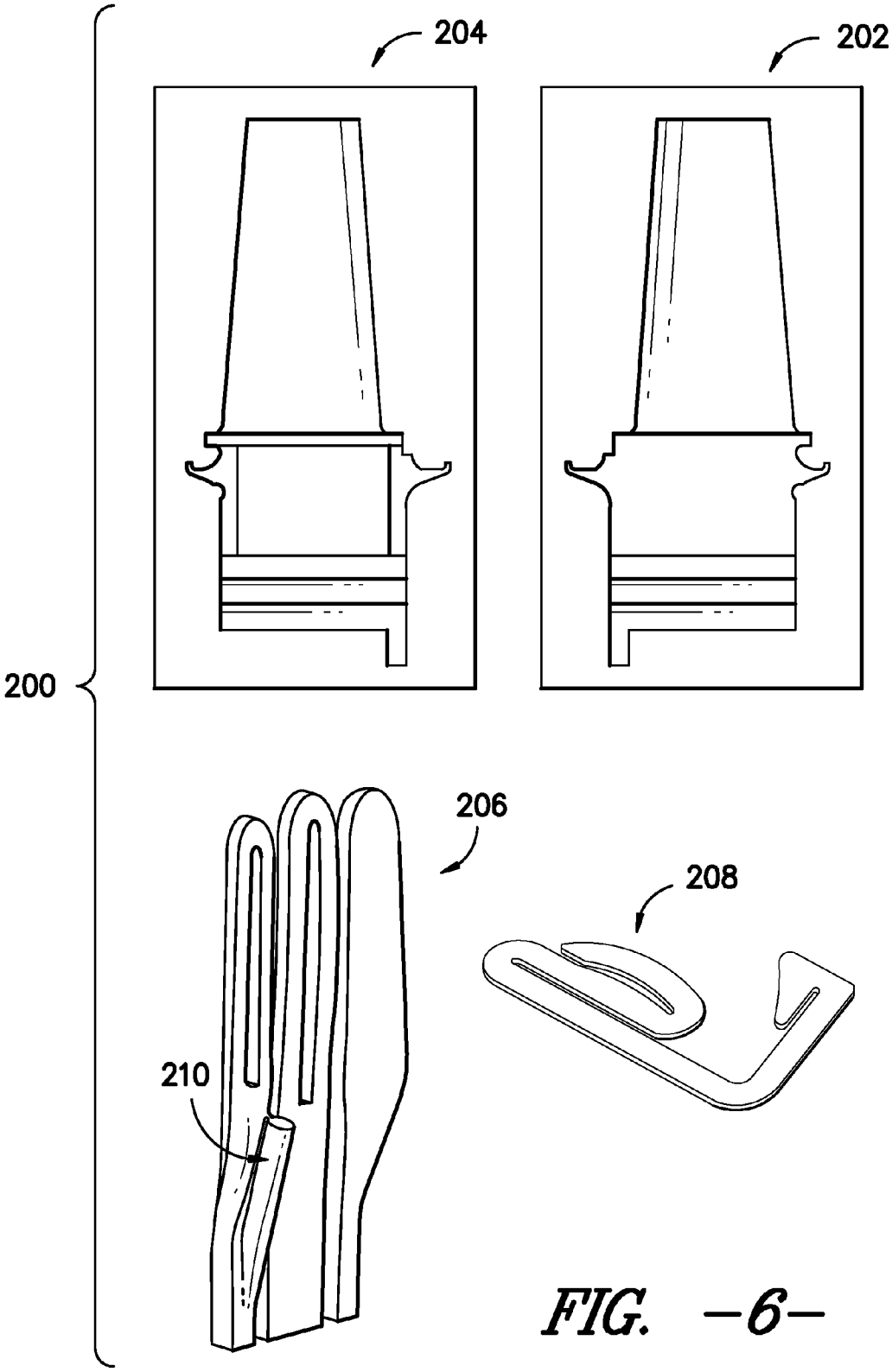
FIG. –6–

BUCKET ASSEMBLY COOLING APPARATUS AND METHOD FOR FORMING THE BUCKET ASSEMBLY

FIELD OF THE INVENTION

The subject matter disclosed herein relates generally to turbine buckets, and more specifically to cooling apparatus for bucket assemblies.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

Various strategies are known in the art for cooling various gas turbine system components. For example, a cooling medium may be routed from the compressor and provided to various components. In the turbine section of the system, the cooling medium may be utilized to cool various turbine components.

Turbine buckets are one example of a hot gas path component that must be cooled. For example, various parts of the bucket, such as the airfoil, the platform, the shank, and the dovetail, require cooling. Thus, various cooling circuits may be defined in the various parts of the bucket, and cooling medium may be flowed through the various cooling circuits to cool the bucket.

Specifically, various strategies are known for cooling the platform. For example, a cooling circuit may be provided in the platform, and cooling medium may be supplied to this cooling circuit to cool the platform. However, various difficulties may be encountered in providing the cooling medium to the platform cooling circuit. For example, one strategy for providing cooling medium to the platform cooling circuit requires that, during casting or otherwise forming the bucket, the core pieces that form the platform cooling circuit and various other cooling circuits are placed in communication with each other. According to this strategy, no post-cast modification of the bucket is required, and the other various cooling circuits may supply cooling medium to the platform cooling circuit. However, placing the platform cooling circuit core and other cooling circuit cores in communication with each other may prevent the various wall thicknesses of the bucket associated with the cores from being independently controlled during casting without overstraining the cores. For example, this may increase the thermally induced strains associated with the cores, and may crack the cores.

Another strategy for providing cooling medium to the platform cooling circuit requires that, after casting of the bucket, a bore hole is drilled from the exterior of the bucket. The bore hole may place the platform cooling circuit in communication with another cooling circuit, such that the other cooling circuit may supply cooling medium to the platform cooling circuit. However, this bore hole must then be plugged from the exterior to prevent cooling medium from escaping. This plugging operation may not be desirable, as it may provide a failure point for the bucket and be relatively unreliable.

Thus, an improved apparatus for cooling a bucket would be desired. Specifically, an improved apparatus for providing cooling medium to a platform cooling circuit in a bucket would be advantageous. Further, a method for forming a bucket with an improved apparatus for providing cooling medium to the platform cooling circuit would be desired.

BRIEF DESCRIPTION OF THE INVENTION

Aspects and advantages of the invention will be set forth in part in the following description, or may be obvious from the description, or may be learned through practice of the invention.

In one embodiment, a bucket assembly is disclosed. The bucket assembly includes a platform, an airfoil, and a lower body portion. The platform defines a platform cooling circuit configured to flow cooling medium therethrough. The airfoil extends radially outward from the platform. The lower body portion extends radially inward from the platform. The lower body portion defines a root and a cooling passage extending from the root. The cooling passage is configured to flow cooling medium therethrough. The platform and lower body portion further include a ligament between the cooling passage and the platform cooling circuit. The ligament defines a bore hole extending through the ligament between the cooling passage and the platform cooling circuit.

In another embodiment, a method for forming a bucket assembly is disclosed. The method includes forming the bucket assembly in a mold. The mold includes a platform cooling circuit core and a body cooling circuit core. The bucket assembly includes a platform, an airfoil, and a lower body portion. The platform defines a platform cooling circuit formed by the platform cooling circuit core. The airfoil extends radially outward from the platform. The lower body portion extends radially inward from the platform. The lower body portion defines a root and a cooling passage extending from the root. The cooling passage is formed by the body cooling circuit core and configured to flow cooling medium therethrough. The platform and lower body portion further including a ligament between the cooling passage and the platform cooling circuit. The method further includes, after forming the bucket assembly in the mold, forming a bore hole in the ligament between the cooling passage and the platform cooling circuit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic illustration of a gas turbine system;

FIG. 2 is a sectional side view of the turbine section of a gas turbine system according to one embodiment of the present disclosure;

FIG. 3 is a perspective view of one embodiment of a bucket assembly of the present disclosure;

FIG. 5 is a perspective view of another embodiment of a bucket assembly of the present disclosure; and FIG. 6 is a perspective view of one embodiment of various components of a mold for casting a bucket assembly of the present disclosure.

DETAILED DESCRIPTION OF THE INVENTION

Figure 4:
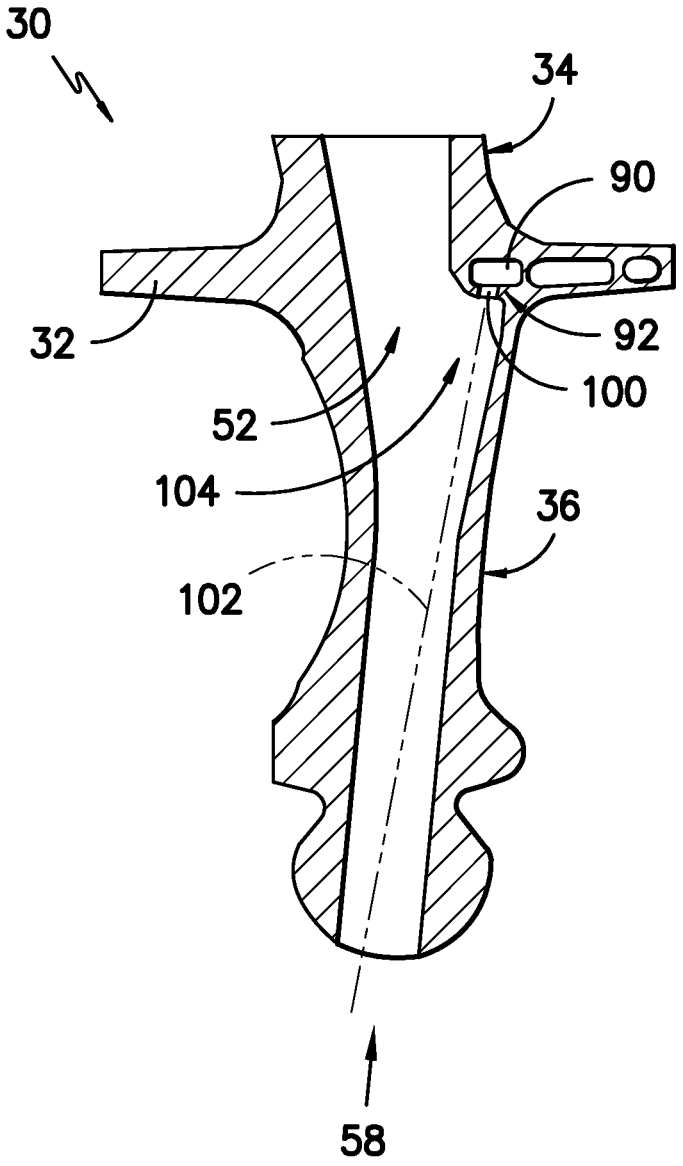
FIG. 4 is a cross-sectional view of one embodiment of a bucket assembly of the present disclosure along the line 4-4 of FIG. 3.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

The turbine 16 may include a plurality of turbine stages. For example, in one embodiment, the turbine 16 may have three stages, as shown in FIG. 2. For example, a first stage of the turbine 16 may include a plurality of circumferentially spaced nozzles 21 and buckets 22. The nozzles 21 may be disposed and fixed circumferentially about the shaft 18. The buckets 22 may be disposed circumferentially about the shaft 18 and coupled to the shaft 18. A second stage of the turbine 16 may include a plurality of circumferentially spaced nozzles 23 and buckets 24. The nozzles 23 may be disposed and fixed circumferentially about the shaft 18. The buckets 24 may be disposed circumferentially about the shaft 18 and coupled to the shaft 18. A third stage of the turbine 16 may include a plurality of circumferentially spaced nozzles 25 and buckets 26. The nozzles 25 may be disposed and fixed circumferentially about the shaft 18. The buckets 26 may be disposed circumferentially about the shaft 18 and coupled to the shaft 18. The various stages of the turbine 16 may be disposed in the turbine 16 in the path of hot gas flow 28. It should be understood that the turbine 16 is not limited to three stages, but rather that any number of stages are within the scope and spirit of the present disclosure.

Each of the buckets 22, 24, 26 may comprise a bucket assembly 30, as shown in FIGS. 3 through 5. The bucket assembly 30 may include a platform 32, an airfoil 34, and a lower body portion 36. The airfoil 34 may extend radially outward from the platform 32, and may generally include a pressure side 42 and a suction side 44 extending between a leading edge 46 and a trailing edge 48.

The lower body portion 36 may extend radially inward from the platform 32. The lower body portion 36 may generally define a root 50 of the bucket assembly 30. The root 50 may generally be the base portion of the bucket assembly 30. Further, the lower body portion 36 may define a cooling passage or a plurality of cooling passages extending therethrough. For example, as shown in FIG. 3, the lower body portion 36 may define a leading edge cooling passage 52, a middle cooling passage 54, and a trailing edge cooling passage 56. In exemplary embodiments, the cooling passages 52, 54, 56 may extend from the root 50 through the lower body portion 36. The cooling passages 52, 54, 56 may be configured to flow cooling medium 58 therethrough. For example, openings 62, 64, and 66 of the cooling passages 52, 54, and 56, respectively, may be defined in the lower body portion 36, such as in the root 50. The openings 62, 64, 66 may be provided to accept cooling medium 58, such that the cooling medium 58 may flow through the cooling passages 52, 54, 56.

The cooling passages 52, 54, 56 may further be fluidly connected to airfoil cooling circuits. For example, as shown in FIG. 3, leading edge cooling passage 52 may be fluidly connected to airfoil cooling circuits 70 and 72, middle cooling passage 54 may be fluidly connected to airfoil cooling circuits 74 and 76, and trailing edge cooling passage 56 may be fluidly connected to airfoil cooling circuit 78. The airfoil cooling circuits may generally be defined in the airfoil 34, and may flow the cooling medium 58 from the cooling passages 52, 54, 56 through the airfoil 34, cooling the airfoil 34.

It should be understood that the bucket assembly 30 is not limited to the cooling passages 52, 54, 56 and airfoil cooling circuits 70, 72, 74, 76, 78 disclosed above. Rather, any number and formation of cooling passages and cooling circuits may be defined in the bucket assembly 30, and are understood to be within the scope and spirit of the present disclosure.

The lower body portion 36 may, in exemplary embodiments, include a shank 80 and dovetail 82. The shank 80 may include a plurality of angel wings 84 extending therefrom. The dovetail 82 may define the root 50, and may further be configured to couple the bucket assembly 30 to the shaft 18. For example, the dovetail 82 may secure the bucket assembly 30 to a rotor disk (not shown) disposed on the shaft 18. A plurality of bucket assemblies 30 may thus be disposed circumferentially about the shaft 18 and coupled to the shaft 18, forming a rotor assembly (not shown). It should be understood, however, that the lower body portion 36 is not limited to embodiments including a shank 80 and a dovetail 82. Rather, any configuration of the lower body portion 36 is understood to be within the scope and spirit of the present disclosure.

The platform 32 of the bucket assembly 30 may define a platform cooling circuit 90. The platform cooling circuit 90 may generally extend through the platform 32, and may be configured to flow cooling medium 58 therethrough, cooling the platform 32. The platform cooling circuit 90 may extend through the platform 32 having any suitable configuration for cooling the platform 32. For example, the platform cooling circuit 90 may be a generally serpentine cooling circuit and/or may have a variety of branches configured to provide cooling medium 58 to various portions of the platform 32. The platform cooling circuit 90 may further include various portions that extend through the platform 32 adjacent to the pressure side 42, the suction side 44, the leading edge 46, and/or the trailing edge 48 of the airfoil 34, such that those portions of the platform 32 are adequately cooled, as required.

The platform 32 and lower body portion 36 may further include a ligament 92. The ligament 92 may be that portion of the bucket assembly 30 that extends between any of the cooling passages 52, 54, 56 and the platform cooling circuit 90, separating the cooling passages 52, 54, 56 and the platform cooling circuit 90. Thus, it should be understood that the platform cooling circuit 90 is independent from the cooling circuit or circuits defined by the cooling passages 52, 54, 56 and airfoil cooling circuits 70, 72, 74, 76, 78, and may be manufactured and defined in the bucket 30 independently of the cooling passages 52, 54, 56 and airfoil cooling circuits 70, 72, 74, 76, 78, as discussed below.

Thus, in order to provide cooling medium 58 to the platform cooling circuit 90, a bore hole 100 or plurality of bore holes 100 may be defined in the ligament 92. The bore holes 100 may extend generally through the ligament 92 between any of the cooling passages 52, 54, 56 and the platform cooling circuit 90. The bore holes 100 may allow cooling medium 58 flowing through the cooling passages 52, 54, 56 to flow through the bore holes 100 and into the platform cooling circuit 90. In exemplary embodiments, the bore holes 100 may extend generally and/or approximately radially outward from the cooling passages through the ligament 92 to the platform cooling circuit 90.

In exemplary embodiments as illustrated in FIGS. 3 and 4, for example, a bore hole 100 or plurality of bore holes 100 may be defined in the ligament 92 between the leading edge cooling passage 52 and the platform cooling circuit 90. Thus, a portion of the cooling medium 58 flowing through the leading edge cooling passage 52 may flow through the bore hole 100 or bore holes 100 to the platform cooling circuit 90.

Further, in some exemplary embodiments, one or more of the cooling passages 52, 54, 56 may provide a line-of-sight 102 from the root 50 through the ligament 92 to the platform cooling circuit 90. The line-of-sight 102 may, for example, allow a worker manufacturing a bucket assembly 30 to look through the root 50 and, once a bore hole 100 or bole holes 100 have been defined in the ligament 92, visualize at least a portion of the platform cooling circuit 90. As discussed below, the line-of-sight 102 may enable the worker to properly form the bore hole 100 or bore holes 100 in the ligament 92, by positioning the bore hole 100 or bore holes 100 along the line-of-sight 102.

Thus, the bore hole 100 or bore holes 100 may be defined in the ligament 92, and may extend through the line-of-sight 102 between a cooling passage, such as one of the cooling passages 52, 54, 56, and the platform cooling circuit 90. For example, in exemplary embodiments as illustrated in FIGS. 3 and 4, a line-of-sight 102 may be provided through the leading edge cooling passage 52, such that a worker looking through the opening 62 defined in the root 50 may be able to visualize the platform cooling circuit 90.

In further exemplary embodiments, the cooling passage through which the line-of-sight 102 extends, such as leading edge cooling passage 52 and/or the cooling passages 54, 56, may include a protrusion 104. The protrusion 104 may be an extra or additional portion of the cooling passage that may be defined in the lower body portion 36. Further, the protrusion 104 may extend from and be in fluid communication with the cooling passage. The protrusion 104 may provide the line-of-sight 102 from the root 50 through the ligament 92 to the platform cooling circuit 90. For example, in many embodiments, the cooling passages 52, 54, 56 may not provide lines-of-sight 102 to the platform cooling circuit 90. The protrusion 104 may be added to one or more of the cooling passages 52, 54, 56 during forming of the bucket assembly 30 to provide the line-of-sight 102 to the platform cooling circuit 90, as discussed below.

In some exemplary embodiments, as shown in FIG. 3, the platform 32 may further define an exhaust passage 106 or a plurality of exhaust passage 106. The exhaust passages 106 may, for example, extend from the platform cooling circuit 90 through the platform 32 to the exterior of the platform 32. The exhaust passages 106 may thus be configured to exhaust cooling medium 58 from the platform cooling circuit 90 adjacent to the platform 32. For example, at least a portion of the cooling medium 58 flowing through the platform cooling circuit 90 may flow into and through the exhaust passages 106, thus being exhausted from the platform cooling circuit 90.

In some exemplary embodiments, as shown in FIG. 5, bore holes 100 may be defined in the ligament 92 extending between more than one of the cooling passages and the platform cooling circuit 90. For example, FIG. 5 illustrates a bucket assembly 30 according to another embodiment of the present disclosure, wherein the lower body portion 36 defines a leading edge cooling passage 152, a middle cooling passage 154, and a trailing edge cooling passage 156, as well as openings 162, 164, 166. The cooling passages 152, 154, 156 may further be fluidly connected to airfoil cooling circuits 170, 172, 174, 176, 178. As shown in FIG. 5, a bore hole 100 or plurality of bore holes 100 extend through ligament 92 from both the leading edge cooling passage 152 and the trailing edge cooling passage 156 to the platform cooling circuit 90.

In some embodiments, all of the bore holes 100 extending from the cooling passages to the platform cooling circuit 90 may be configured to flow cooling medium 58 to the platform cooling circuit 90. In alternative embodiments, however, some of the bore holes 100 may be configured to flow cooling medium 58 from the platform cooling circuit 90 to one or more of the cooling passages, thus exhausting the cooling medium 58 from the platform cooling circuit 90. For example, as shown in FIG. 5, bore hole 100 extending from the leading edge cooling passage 152 to the platform cooling circuit 90 may flow cooling medium 58 from the leading edge cooling passage 152 to the platform cooling circuit 90, while bore holes 100 extending from trailing edge cooling passage 156 to the platform cooling circuit 90 may flow cooling medium 58 from the platform cooling circuit 90 to the trailing edge cooling passage 156. Thus, in this embodiment, at least a portion of the cooling medium 58 provided to the bucket assembly 30 may flow from the leading edge cooling passage 152 through the platform cooling circuit 90, cooling the platform cooling circuit 90, and may then be exhausted from the platform cooling circuit 90 through bore holes 100 into the trailing edge cooling passage 156.

The present disclosure is further directed to a method for forming a bucket assembly 30. For example, FIG. 6 illustrates various components of one embodiment of a mold 200 for forming a bucket assembly 30. The mold 200 may include, for example, a shell. The shell may include a lower shell 202 and an upper shell 204, as shown, or may be a unitary shell, or may have any variety and configuration of shell parts. The shell 202, 204 may, for example, be configured to accept a bucket assembly 30 substrate for forming the bucket assembly 30 in the shell 202, 204. In exemplary embodiments, the bucket assembly 30 may be cast. Alternatively, however, the bucket assembly 30 may be formed through any suitable manufacturing process.

The mold 200 may further include a body cooling circuit core 206. The body cooling circuit core 206 may generally include core pieces that define the various cooling passages and cooling circuits in the lower body portion 36 and the airfoil 34 of the bucket assembly 30, such as cooling passages 52, 54, 56 or 152, 154, 156 and airfoil cooling circuits 70 through 78 or 170 through 178. The body cooling circuit core 206 may be a unitary core, defining all of the various cooling passages and cooling circuits, or may include various core parts configured to define any variety of the various cooling passages and cooling circuits.

The mold 200 may further include a platform cooling circuit core 208. The platform cooling circuit core 208 may generally be a core piece that defines the platform cooling circuit 90 in the platform 32 of the bucket assembly 30. The platform cooling circuit core 208 may be a unitary core, defining all of the various portions of the platform cooling circuit 90, or may include various core parts configured to define the various portions.

It should be understood that the platform cooling circuit core 208 of the present disclosure is independent from the body cooling circuit core 206. Thus, when the bucket assembly 30 is formed, the use of independent cores 206 and 208 may allow the various wall thicknesses of the bucket assembly 30 associated with the cores 206 and 208 to be independently controlled without overstraining the cores 206, 208. For example, this may reduce any thermally induced strains associated with the cores 206, 208.

Thus, forming a bucket assembly 30 in accordance with the present disclosure may include, for example, forming the bucket assembly 30 in the mold 200. In exemplary embodiments, as mentioned, the bucket assembly 30 may be formed through casting.

As discussed above, the bucket assembly 30 formed in the mold 200 may include a ligament 92 separating the cooling passages, such as cooling passages 52, 54, 56 or cooling passages 152, 154, 156, and the platform cooling circuit 90. Thus, forming a bucket assembly 30 in accordance with the present disclosure may further include, for example, forming a bore hole 100 or bore holes 100 in the ligament 92. The bore holes 100 may extend through the ligament 92 between any of the cooling passages, as required and discussed above, and the platform cooling circuit 90. Further, in some exemplary embodiments, as discussed above and below, the bore holes 100 may extend through lines-of-sight 102.

In general, the bore holes 100 may be formed after forming of the bucket assembly 30, such as after the bucket assembly 30 is allowed to set in the mold 200 and/or after the bucket assembly 30 is removed from the mold 200. The bore holes 100 may be formed by, for example, drilling through the ligament 92 using a drill bit, an electrical discharge machining ("EDM") electrode, or any other suitable drilling apparatus. It should be understood that the present disclosure is not limited to drilling. Rather, any methods and apparatus for forming a bore hole 100 in a ligament 92 are understood to be within the scope and spirit of the present disclosure.

In exemplary embodiments, the present method for forming a bucket assembly 30 may allow the sizes and shapes of the bore holes 100 to be modified and adjusted after forming of the bucket assembly 30. For example, after forming the bucket assembly 30, bore holes 100 may be formed. The bucket assembly 30 may then be tested to evaluate, for example, the cooling performance of the various cooling passages and the platform cooling circuit 90. If the cooling performance of the platform cooling circuit 90 is, for example, inadequate, the bore holes 100 may simply be adjusted. For example, the bore holes 100 may be enlarged or otherwise modified to increase or otherwise adjust the cooling performance, or other additional bore holes 100 may be formed. These adjustments may require, for example, simply boring out the bore holes 100 to make them larger, otherwise modifying the shape and/or size of the bore holes 100, or adding additional bore holes 100, rather than requiring reforming or otherwise modifying the bucket assembly 30.

In some embodiments, the cooling passage or passages from which bore hole 100 or bore holes 100 extend may provide lines-of-sight 102 from the root 50 of the bucket assembly 30 through the ligament 92 to the platform cooling circuit 90. For example, in one exemplary embodiment as shown in FIGS. 3 and 4, leading edge cooling passage 52 may provide a line-of-sight 102. In another exemplary embodiment as shown in FIG. 5, leading edge cooling passage 152 and trailing edge cooling passage 156 may both provide lines-of-sight 102.

Further, in some embodiments, the body cooling circuit core 206 may include a protrusion core 210 or protrusion cores 210. The protrusion cores 210 may define the protrusions 104 included in various cooling passages, as discussed above. Thus, when the bucket assembly 30 is formed in the mold 200, the protrusions 104 may be formed through inclusion of the protrusion cores 210 in the mold 200. As discussed above, the protrusions 104 formed by the protrusion cores 210 may provide the lines-of-sight 102 from the root 50 of the bucket assembly 30 through the ligament 92 to the platform cooling circuit 90.

Thus, the bucket assembly 30 and method for forming the bucket assembly 30 of the present disclosure may allow the bore hole 100 or bore holes 100 to be formed without requiring any exterior modification of the bucket assembly 30. For example, as discussed above, a worker forming a bucket assembly 30 may form the bore holes 100 through the ligament 92 from one or more of the various cooling passages to the platform cooling circuit 90. Further, in exemplary embodiments, various lines-of-sight 102 and protrusions 104 may be provided to assist the worker in forming the bore holes 100. Beneficially, no plugging or brazing operations are thus required when forming the bore holes 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bucket assembly comprising:

a platform, the platform defining a platform cooling circuit configured to flow cooling medium therethrough;

an airfoil extending radially outward from the platform; and a lower body portion extending radially inward from the platform, the lower body portion defining a root and a cooling passage extending from the root, the cooling passage configured to flow cooling medium therethrough, the platform and lower body portion further including a ligament between the cooling passage and the platform cooling circuit, the cooling passage providing a direct line-of-sight from a base of the root through the cooling passage and the ligament to the platform cooling circuit, the ligament defining a bore hole extending through the line-of-sight between the cooling passage and the platform cooling circuit.

2. The bucket assembly of claim 1, wherein the ligament defines a plurality of bore holes.

3. The bucket assembly of claim 1, wherein the cooling passage includes a protrusion, the protrusion providing the line-of-sight from the root through the ligament to the platform cooling circuit.

4. The bucket assembly of claim 1, wherein the platform and the lower body portion include a plurality of cooling passages.

5. The bucket assembly of claim 4, wherein the ligament defines a plurality of bore holes.

6. The bucket assembly of claim 5, wherein at least one of the plurality of bore holes is configured to flow cooling medium from at least one of the plurality of cooling passages to the platform cooling circuit, and wherein at least one of the plurality of bore holes is configured to flow cooling medium from the platform cooling circuit to at least one of the plurality of cooling passages.

7. The bucket assembly of claim 1, the platform further defining an exhaust passage, the exhaust passage configured to exhaust cooling medium from the platform cooling circuit adjacent the platform.

8. The bucket assembly of claim 1, wherein the lower body portion includes a shank and a dovetail, the dovetail defining the root.

9. A method for forming a bucket assembly, comprising:

forming the bucket assembly in a mold, the mold including a platform cooling circuit core and a body cooling circuit core, the bucket assembly comprising:

a platform, the platform defining an interior platform cooling circuit formed by the platform cooling circuit core;

an airfoil extending radially outward from the platform; and a lower body portion extending radially inward from the platform, the lower body portion defining a root and an interior cooling passage extending from the root, the interior cooling passage formed by the body cooling circuit core and configured to flow cooling medium therethrough, the platform and lower body portion further including a ligament between the interior cooling passage and the interior platform cooling circuit; and after forming the bucket assembly in the mold, forming a bore hole in the ligament between the interior cooling passage and the platform cooling circuit;

wherein the cooling passage provides a direct line-of-sight from a base of the root through the cooling passage and the ligament to the interior platform cooling circuit.

10. The method of claim 9, wherein forming the bore hole requires no exterior modification of the bucket assembly.

11. The method of claim 9, wherein the bore hole extends through the line-of-sight.

12. The method of claim 9, wherein the body cooling circuit core includes a protrusion core, and wherein the interior cooling passage includes a protrusion formed by the protrusion core, the protrusion providing the line-of-sight from the root through the ligament to the interior platform cooling circuit.

* * * * *